US008585154B2

(12) United States Patent
Williams et al.

(10) Patent No.: US 8,585,154 B2
(45) Date of Patent: Nov. 19, 2013

(54) TUBULAR HEADBAND MOUNTED WET MOP

(75) Inventors: Todd Allen Williams, Aliso Viejo, CA (US); Cynthia Kay Williams, Aliso Viejo, CA (US)

(73) Assignee: Rubbermaid Commerical Products LLC, Winchester, VA (US)

( * ) Notice: Subject to any disclaimer, the term of this patent is extended or adjusted under 35 U.S.C. 154(b) by 22 days.

(21) Appl. No.: 13/221,275

(22) Filed: Aug. 30, 2011

(65) Prior Publication Data

US 2012/0056466 A1 Mar. 8, 2012

Related U.S. Application Data

(60) Provisional application No. 61/379,402, filed on Sep. 2, 2010.

(51) Int. Cl.
*A47L 13/20* (2006.01)
*A46D 3/04* (2006.01)

(52) U.S. Cl.
USPC ..... 300/21; 15/229.1; 15/229.2; 15/229.8; 15/115; 15/118

(58) Field of Classification Search
USPC ..... 15/229.2, 229.1, 229.4, 229.8, 115, 15/118, 116; 300/21
See application file for complete search history.

(56) References Cited

U.S. PATENT DOCUMENTS

| | | | | |
|---|---|---|---|---|
| 1,398,245 | A | 11/1921 | Toplitz | |
| 1,450,556 | A | 4/1923 | McKeever | |
| 1,576,777 | A | 3/1926 | Moore | |
| 2,686,328 | A * | 8/1954 | Kirby | 15/229.1 |
| 3,135,002 | A | 6/1964 | Moss | |
| 3,324,497 | A | 6/1967 | Moss | |
| 3,795,934 | A | 3/1974 | Moss | |
| 3,966,259 | A | 6/1976 | Richards | |
| 3,981,040 | A * | 9/1976 | Crofton | 15/229.2 |
| 5,784,746 | A | 7/1998 | Williams et al. | |
| 5,848,451 | A | 12/1998 | Barnett | |
| 6,212,729 | B1 | 4/2001 | Weichelt et al. | |
| 6,270,166 | B2 | 8/2001 | Weichelt et al. | |
| 2008/0016640 | A1 | 1/2008 | Reddy et al. | |

* cited by examiner

*Primary Examiner* — Monica Carter
*Assistant Examiner* — Stephanie Berry
(74) *Attorney, Agent, or Firm* — Kirk A. Buhler; Buhler & Associates

(57) ABSTRACT

There is a need to reduce raw materials used in the manufacturing of wet mops, to reduce the weight of the wet mop which will decrease user fatigue and related injuries and to address the difficulty of attaching standard wet mops to commonly used mop handles. The improvement is a tubular headband wet mop with yarn strands on only one side of the headband, reducing the amount of unused yarn incorporated into the wet mop while not reducing floor surface coverage area. The tubular headband also eliminates the possibility of exposing the bottom side of the mop handle which can damage or mar the floor surface, coatings and finishes. This reduction in raw materials results in a lighter product, which reduces effort required to lift and wring out the wet mop, and reduces fatigue and injuries associated with mopping.

5 Claims, 8 Drawing Sheets

TUBULAR HEADBAND MOUNTED WET MOP

CROSS REFERENCE TO RELATED APPLICATION

This application claims the benefit of Provisional Application Ser. No. 61/379,402 filed Sep. 2, 2011 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to a tubular headband mounted wet mop allowing for ease in mounting a wet mop to a mop handle versus a standard mounted wet mop, while reducing the overall weight of a wet mop required to clean the same surface area versus a standard mounted wet mop.

2. Description of Related Art Including Information Disclosed Under 37 CFR 1.97 and 1.98

Wet mops are typically used to clean floors or other essentially flat surfaces. The mop is manufactured and constructed to provide maximum effectiveness in picking up surface dirt, soils and liquids from the floor surface. A typical standard wet mop is made by sewing a headband in the middle of strands of cord. The headband is then captured by a clamp or retainer on a mop handle. A typical standard wet mop is constructed with a headband sewn to a mop handle, creating a four-sided wet mop. The four-sided mop consists of two exterior sides and two interior sides. The exterior sides are typically the only sides that are in contact with the floor surface. A standard wet mop has the potential to damage flooring surfaces, coatings and finishes when the clamping device of the mop handle comes in contact with the floor surface. Several products and patents have been filed and issued on different types of wet mop heads. Exemplary examples of patents covering these products are disclosed herein.

U.S. Pat. No. 5,784,746 that issued on Jul. 28, 1998 to Todd Williams and U.S. Pat. No. 5,848,451 that issued on Dec. 15, 1998 to Rickie Barnett both disclose mop heads with abrasive or scrubbing surfaces. While these patents disclose mop heads, the mop head is constructed with strands of cord with the headband sewn in mid span of the strands of cord.

U.S. Pat. No. 6,212,729 issued Apr. 10, 2001 and U.S. Pat. No. 6,270,166 that issued on Aug. 7, 2001, both to Joel Weichelt et al., disclose a fabric wet mop. The mop is constructed with strands of cord or filler with a cloth covering. These mops provide two exterior and two interior surfaces for cleaning, but only the exterior surfaces are typically used.

U.S. Pat. No. 3,966,259 that issued on Jun. 29, 1976 to Ernest Richards and U.S. Pat. No. 3,981,040 that issued on Sep. 21, 1976, to John Cofton both disclose a wet mop construction where the mop is constructed by sewing a fabric body with a plurality of pile yarns placed on only one side of the fabric body. The pile of yarns exists on only the outside surface of the mop head. While this patent provides for a construction of mop using one sided fabric, the mop is not constructed from elongated strands of cord and further has limited flexibility to move around obstacles.

What is needed is a headband that eliminates the need for a four sided mop, creating a two-sided mop wherein both sides of the strands or cords are utilized. The elimination of the unused interior sides of a four-sided mop reduces the weight of the mop and also the cost to construct a mop where only half of the strands of cord are in contact with the floor surface area. The headband disclosed in this application provides a solution to this problem.

BRIEF SUMMARY OF THE INVENTION

It is an object of the tubular designed headband wet mop with an enclosed tubular mounting cavity. The tubular headband wet mop is then slid over a clamping device, or is inserted into a jaw clamping device.

It is an object of the tubular designed headband wet mop to eliminate the need to manually fold the headband in half in order to mount the headband to a jaw style handle.

It is another object of the tubular designed headband wet mop to eliminate the need to balance or center the wet mop on the mop clamping device.

It is another object of the tubular designed headband wet mop that by simply sliding the tubular headband onto the clamping arm it reduces or eliminates the difficulty associated with yarns getting hung up on the clamping arm while attaching and removing the wet mop.

It is still another object of the tubular designed headband wet mop to be an improvement upon standard mops that are four sided, with yarn strands on both sides of the headband. By incorporating the tubular headband, one of those sides is eliminated because the yarns can end inside of the headband, thereby potentially reducing the amount of yarn incorporated into the wet mop. These reductions in raw materials result in a lighter product, which will help reduce effort required, fatigue, discomfort, strain and injury while mopping a floor, lifting the mop in and out of the mop bucket and the mop bucket wringer, as well as the reduced effort required to effectively wring out the wet mop. The tubular design completely encases the clamping device, thereby eliminating any potential damage to floor surfaces, coatings and finishes.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

Figure 8:
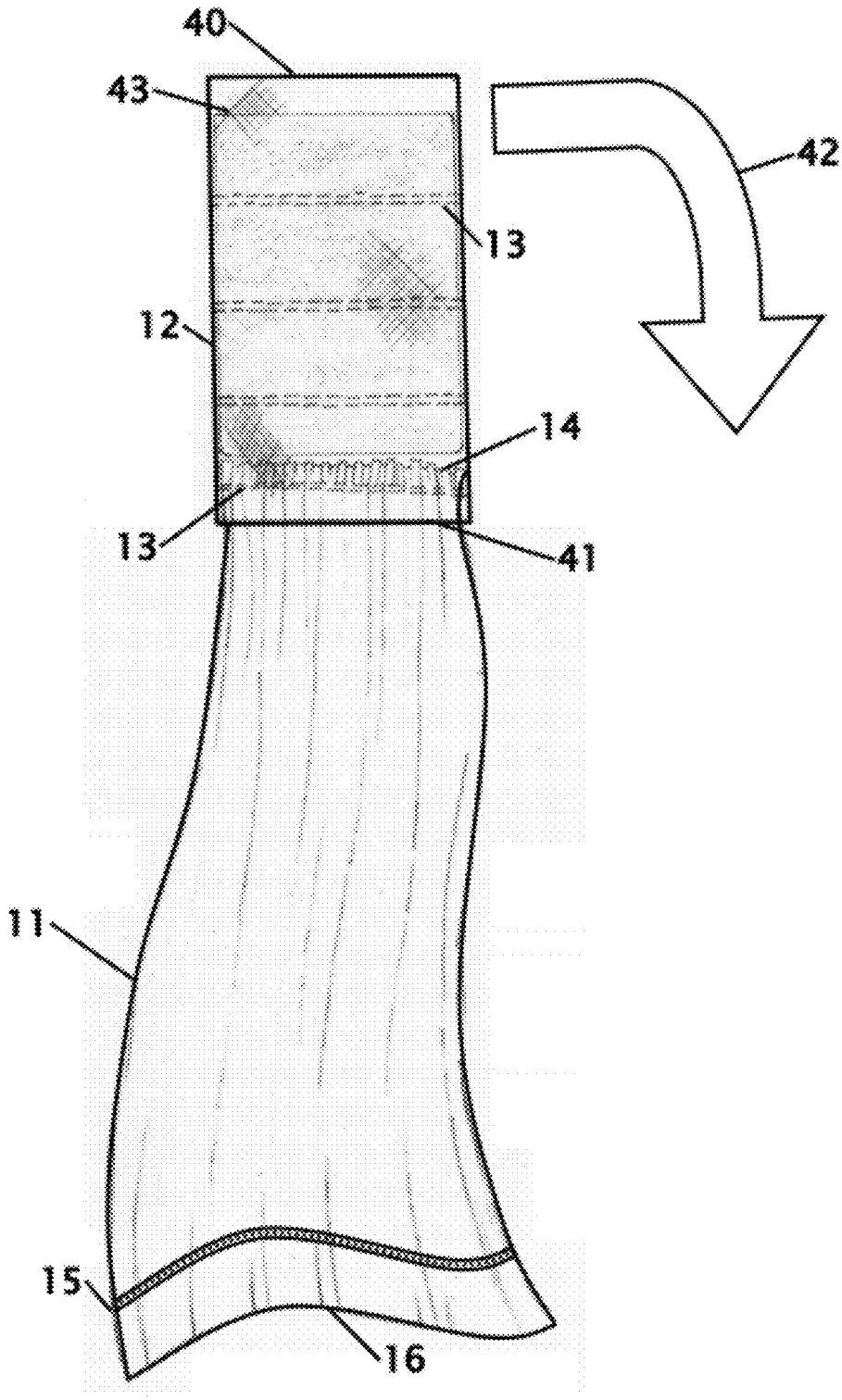

FIG. 8 the wet mop yarn, headband filler material and the headband prior to the headband being looped closed.

DETAILED DESCRIPTION OF THE INVENTION

Figure 1:
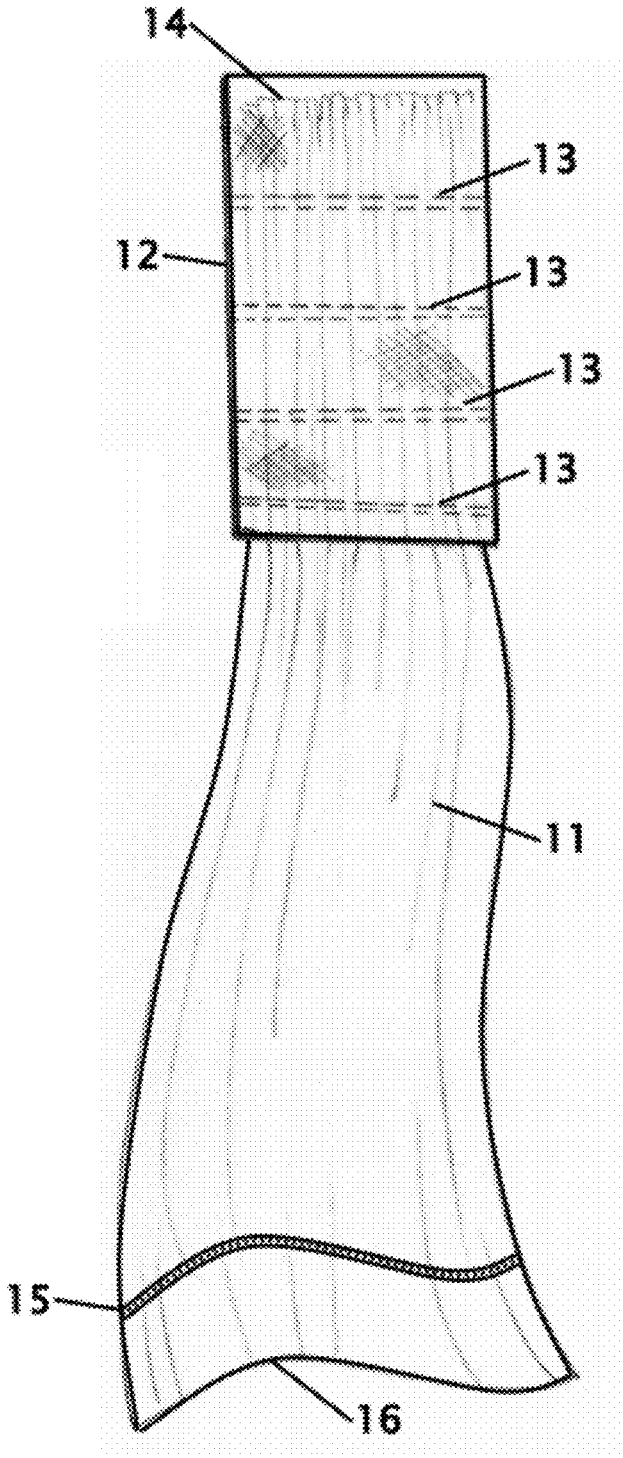
FIG. 1 shows the headband wet mop and yarns prior to the enclosure of the tubular cavity.

FIG. 1 shows the tubular headband wet mop and yarn strands prior to the enclosure of the tubular cavity. 11 is the yarn strands composed of any material such as, but not limited to cotton, microfiber, polyester, rayon, nylon, t-shirt material, synthetics, or blends, ending or looping inside the headband 12. 13 shows possible seam patterns which are designed to retain the yarn strands and provide shaping and support to the headband, these seam patterns may be changed due to manufacturing or other techniques or reasons. The location and form of the seam patterns are not part of this invention. Item 14 shows the yarns ending or looping inside the headband towards the end, however the yarns could end anywhere inside the headband. The mop shown has one tail band 15, but could have 0 to 5 tail bands. 16 is the end of the mop which may be cut end, or looped end.

Figure 2:
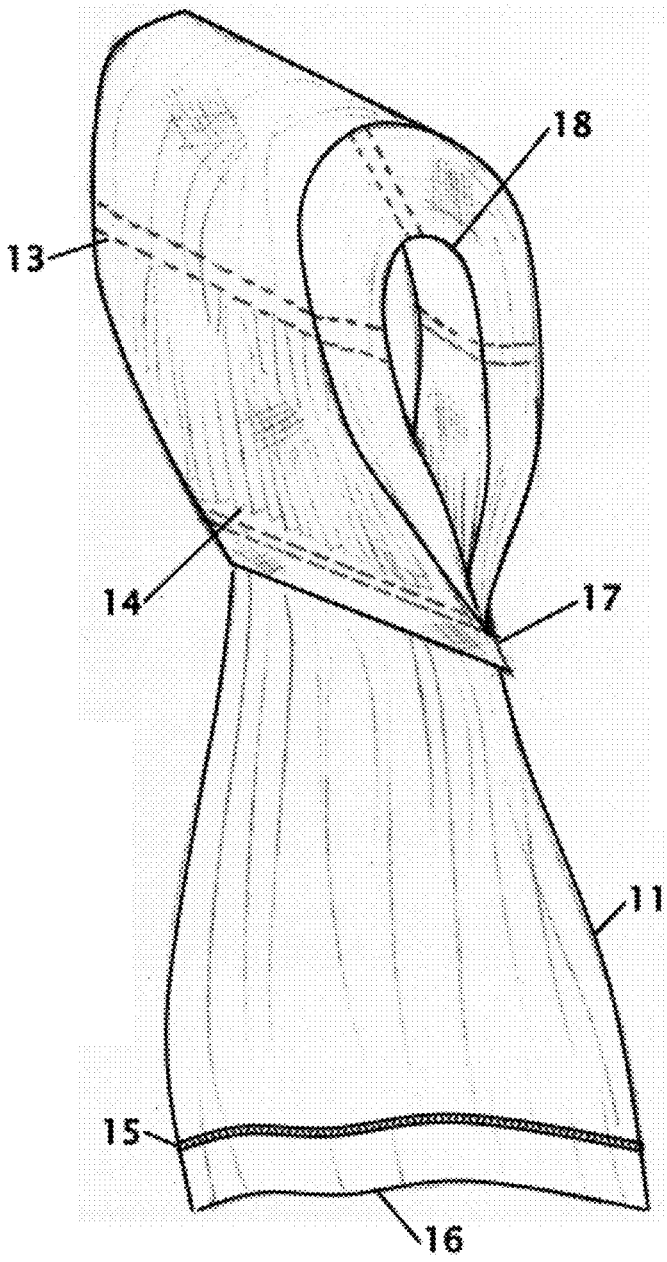
FIG. 2 shows the tubular headband wet mop after enclosure of the tubular cavity of the elements.

FIG. 2 shows the tubular headband wet mop after enclosure of the tubular cavity of the elements referred to above. 17 shows where the headband overlaps itself and is attached with methods such as, but not limited to seams, tape, or staples in order to create the tubular cavity 18.

Figure 3:
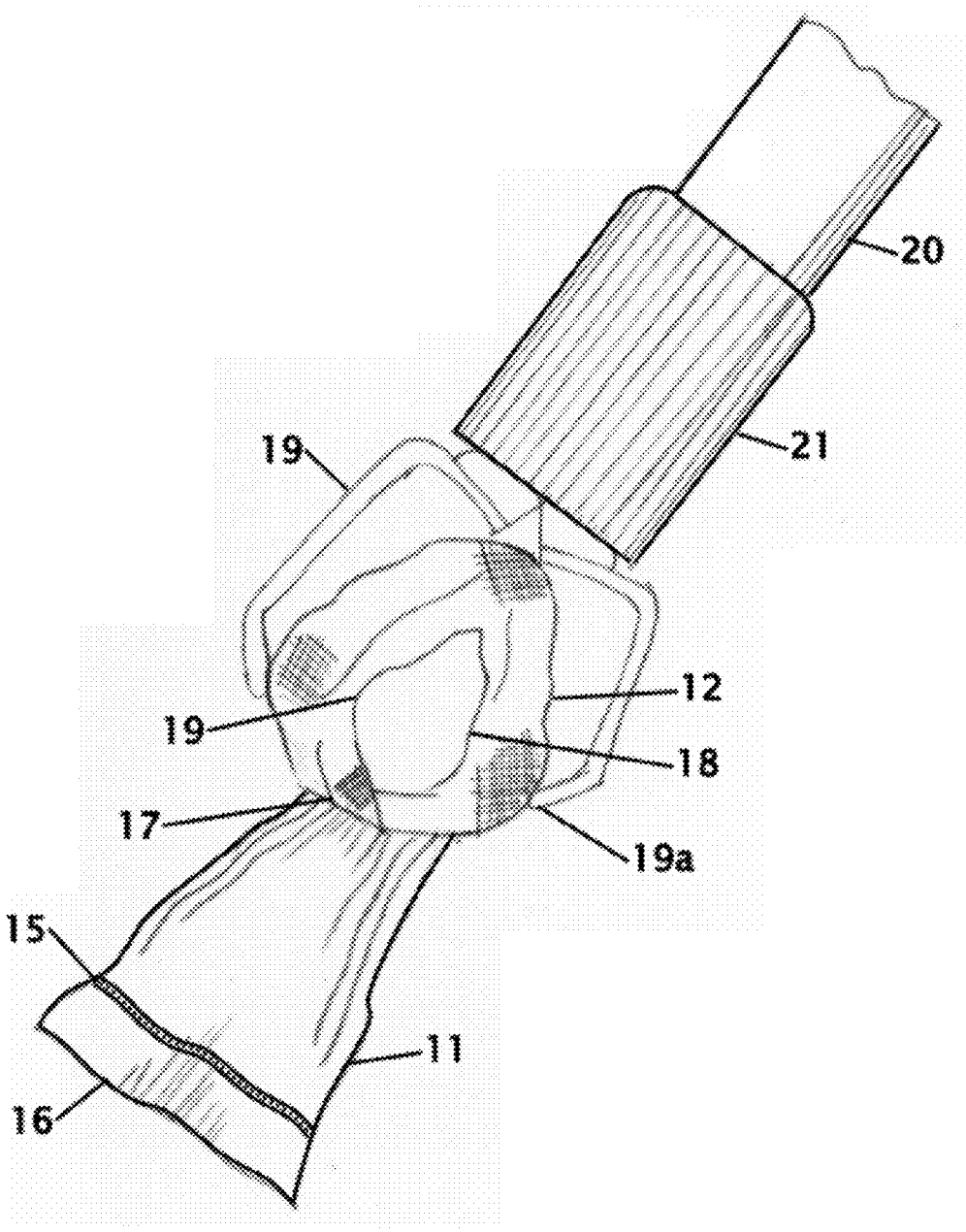
FIG. 3 shows an adjustable jaw connection 19 of the mop handle 20 to the tubular headband wet mop.

FIG. 3 shows an adjustable jaw connection 19 of the mop handle 20 to the tubular headband wet mop 12. Jaw teeth 19*a* penetrate the tubular designed headband 12 at its side. A rotor 21 is rotatable to adjust jaw gripping.

Figure 4:
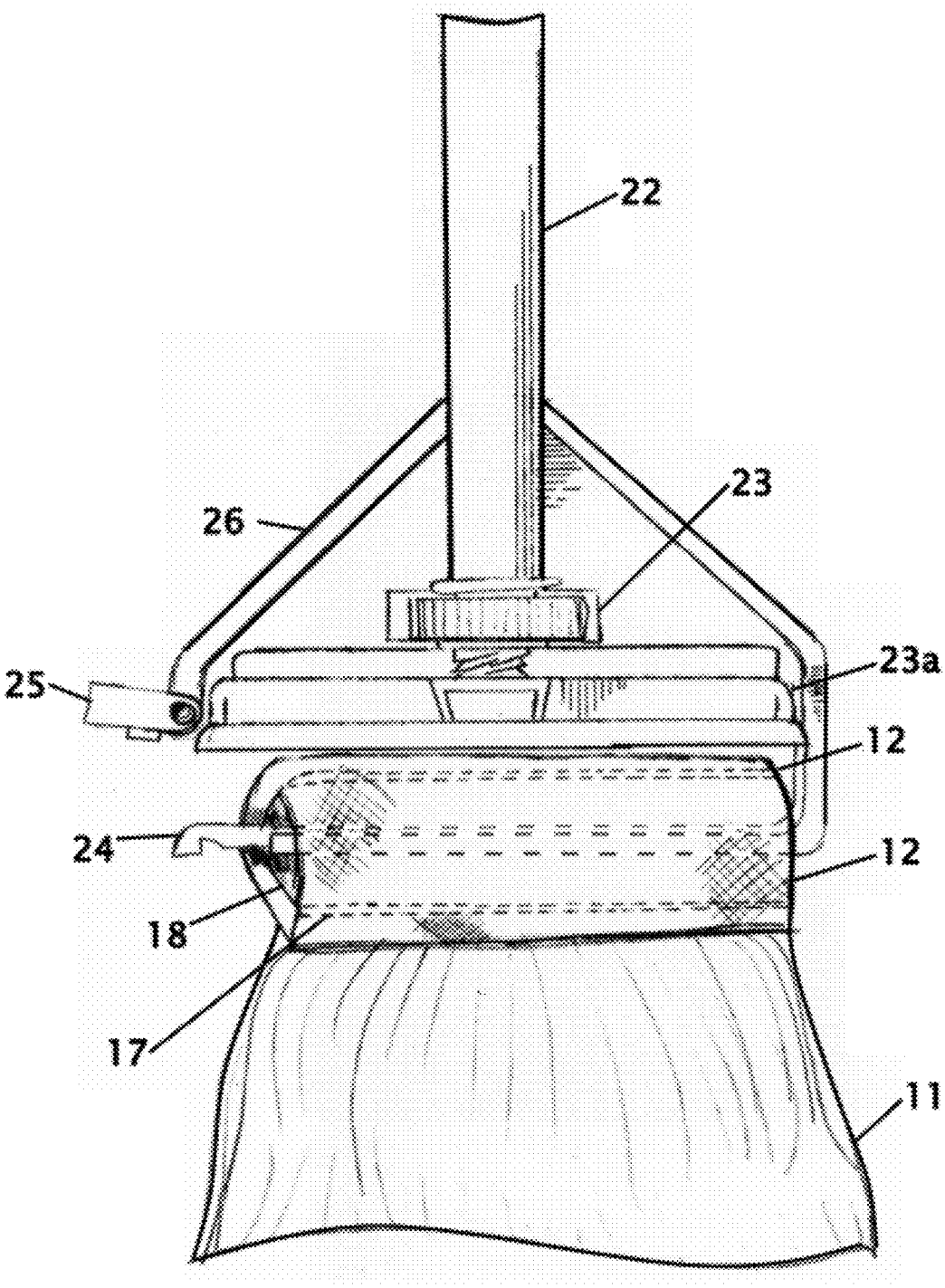
FIG. 4 shows the elements referenced above, with the tubular designed headband mounted on another type of mop handle

FIG. 4 shows the elements referenced above, with the tubular designed headband mounted on another type of mop handle 22. A rotor 23 is adjustable to tighten the plate 23*a* against the headband 12. 24 is the clamping arm that is inserted through the tubular cavity 18. Item 25 shows the locking device that locks onto the clamping arm 24. 26 is the mop handle frame.

Figure 5:
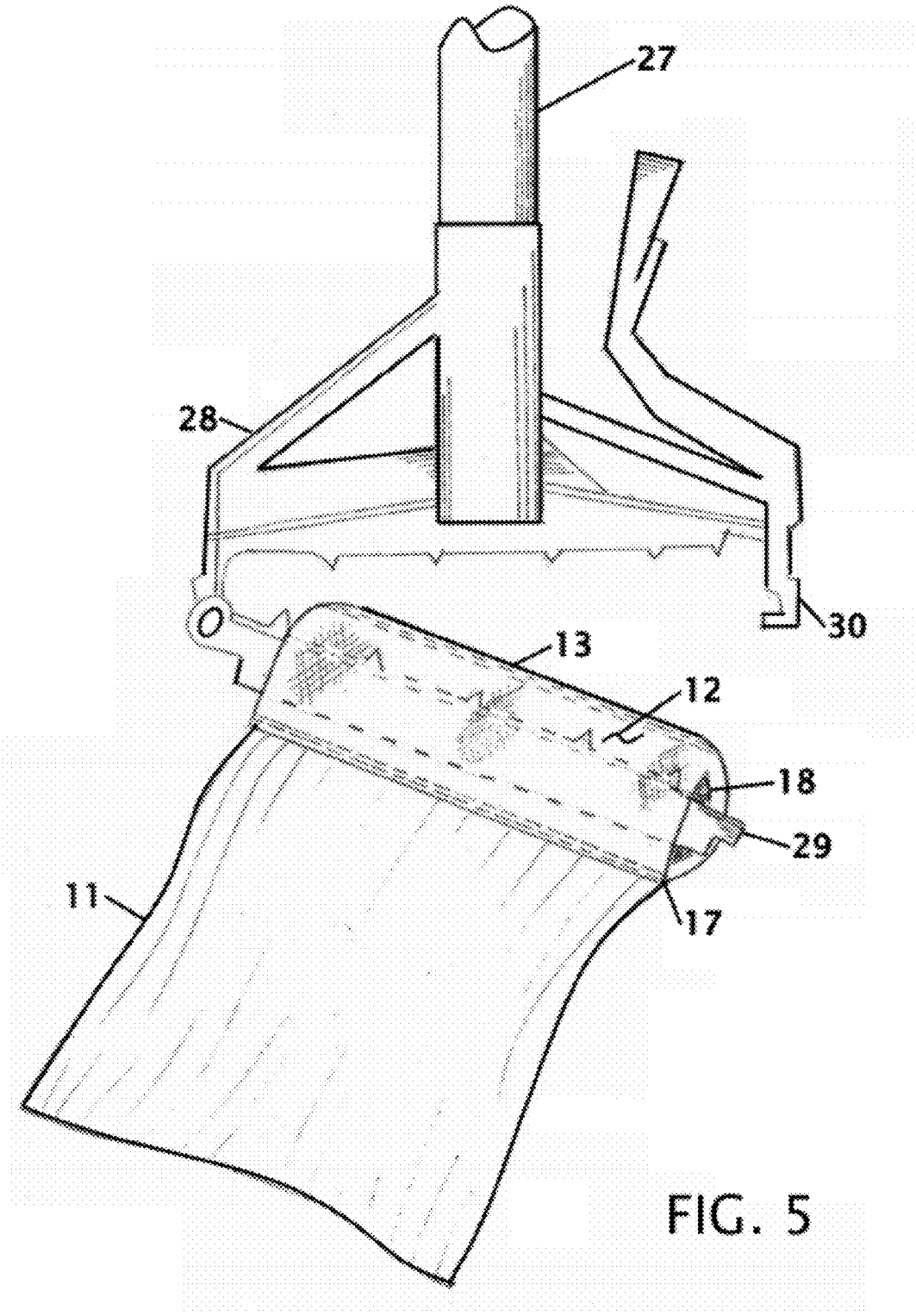
FIG. 5 shows the elements referenced in FIGS. 1, 2 and 3, with the tubular designed headband mounted on another type of mop handle.

FIG. 5 shows the elements referenced in FIGS. 1, 2 and 3, with the tubular designed headband mounted on another type of mop handle 27. Item 29 is the hinged clamping arm that is inserted through the tubular cavity 18. Item 30 shows the locking device that locks onto the hinged clamping arm 29. 28 is the mop handle frame.

Figure 6:
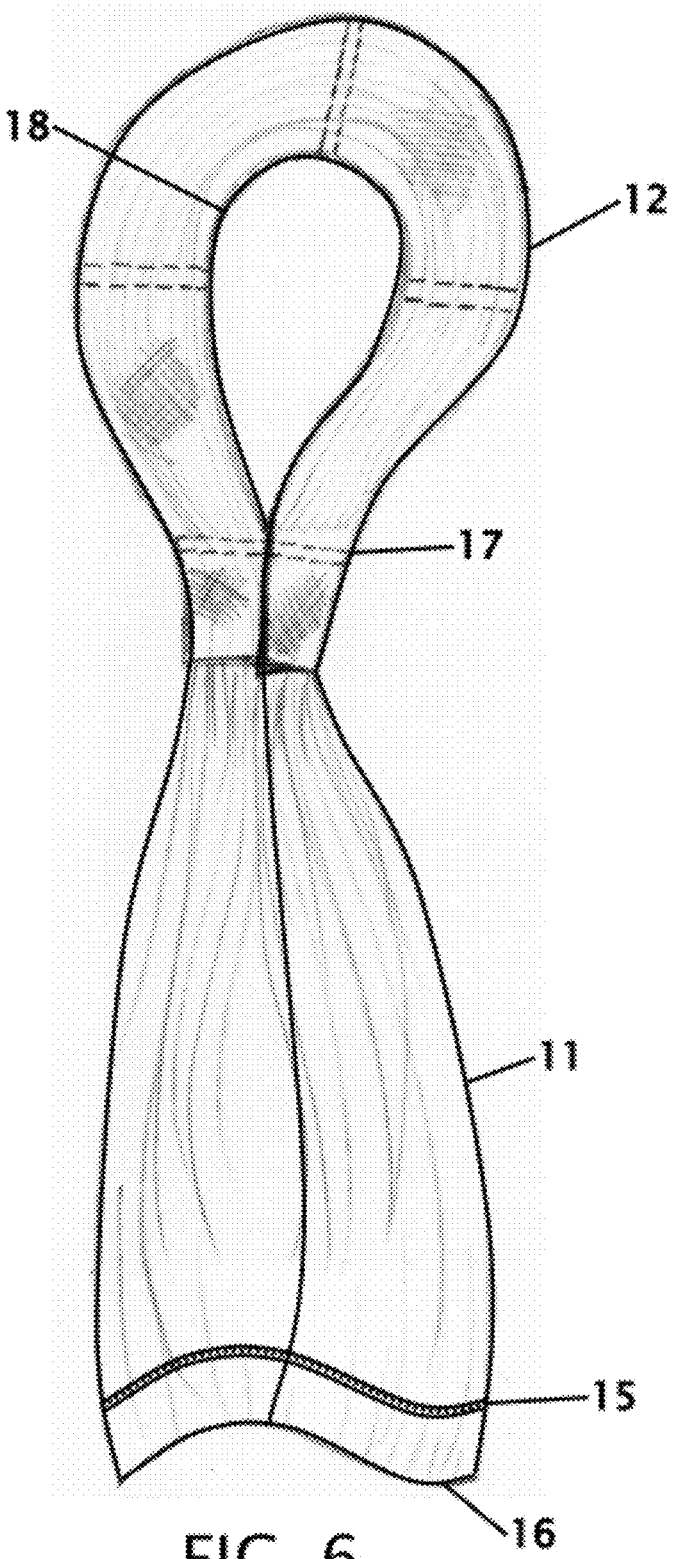
FIG. 6 shows an alternative method for creating the tubular cavity of the tubular headband wet mop wherein the yarns do not end inside the tubular headband.
Figure 7:
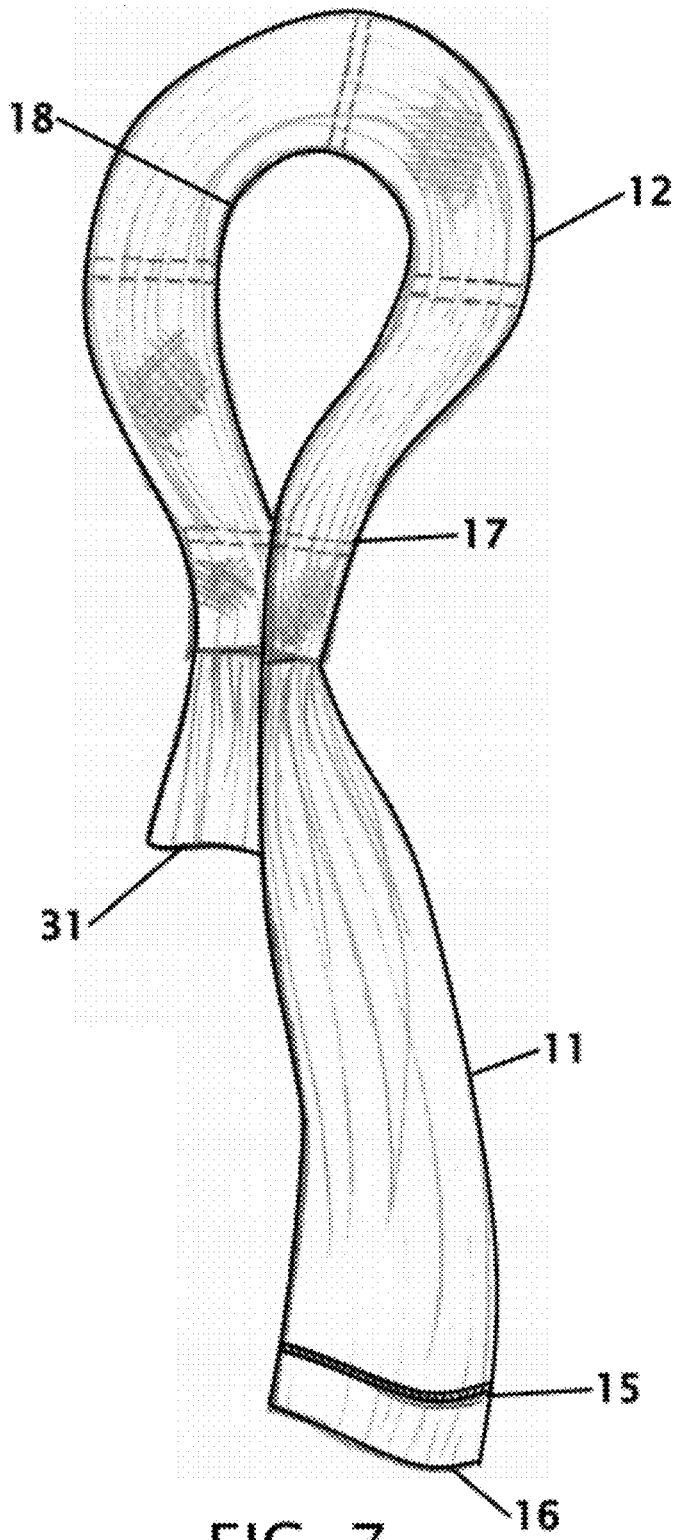
FIG. 7 shows an alternative method for creating the tubular cavity of the tubular headband wet mop wherein the yarns end just outside of the tubular headband.

FIG. 6 shows an alternative method for creating the tubular cavity of the tubular headband wet mop and FIG. 7 shows another alternative method for creating the tubular cavity of the tubular headband wet mop wherein the yarns end just outside 31 of the tubular headband. Item 11 shows the mop strands that pass through both ends of the headband as in a standard wet mop. The enclosing seam 17 shows where the headband overlaps itself and is attached with methods such as, but not limited to seams, tape, or staples in order to create the tubular cavity 18. FIG. 7 shows the yarn strands protruding unequally from the ends of the headband and terminate near the proximal end of the headband.

FIG. 8 shows the wet mop with the headband prior to the headband being looped closed. The mop strands 11 are shown passing into the headband 12. This figure shows that the ends 14 of the mop strands 11 terminate a limited distance within the headband 12 and do not pass completely through the headband. A filler material 43 extends from the ends 14 to the opposing end of the headband 12. The filler material 43 provides structural strength to the headband 12 and can be made from a variety of materials. In the preferred embodiment, the filler material is a yarn, but other materials are contemplated that would provide equivalent function. In fabricating the tubular headband the free end 40 is folded over 42 to join the secured end 41 to make the headband as shown in FIGS. 2-6. The filler material 43 and the mop strands 11 are sewn to the headband 12 at various locations 13. The location and form of the seam patterns 13 are shown for reference, but can be located at any location. This figure shows contemplated locations 13 where possible seam patterns which are designed to retain the yarn strands and any filler and provide shaping and support to the headband. These seam patterns may be changed due to manufacturing or other techniques or reasons. The mop shown has one tail band 15, but could have 0 to 5 tail bands. Item 16 is the end of the mop which may be cut end, or looped end.

The element of the enclosed tubular cavity is necessary to create the ease of mounting, to protect floors from contact with the mop handle clamping device and to enable the reduction of yarn by eliminating two sides of the mop. The ideal use of the tubular headband wet mop would be with the yarns ending inside the headband, creating a two-sided wet mop and reducing the weight of the wet mop.

The tubular headband wet mop is installed by sliding the clamping arm through the tubular cavity and locking the clamping arm or by inserting the tubular headband into the jaw teeth of a jaw style mop handle and clamping closed.

A standard wet mop has yarn protruding from both sides of a flat headband of fabric or mesh, with typically equal amounts of yarn on each side of the headband. This flat headband is then centered and draped over a clamping device essentially folding the mop in half. No other wet mop with a headband uses an enclosed design like the enclosed tubular design with the yarns ending inside of the headband. The tubular design is self-balancing and self-centering, and has the flexibility of eliminating one side of yarn strands.

The process of mounting the standard wet mop can be cumbersome because it requires that the mop be centered and balanced over a clamping arm, while ensuring that no yarn strands get hung up on the handle, and securing the wet mop, while at the same time holding the mop handle upright. The tubular design creates a very simplistic mounting process by simply sliding the tubular mounting cavity over a clamping device, eliminating the need to balance and eliminating or reducing yarn hang-up during mounting.

The tubular design can also eliminate the need for the second side of a wet mop, while maintaining or increasing the floor surface coverage area. Because the headband is a tubular design, there is no second side needed, the band is circular, and is designed to allow for only one section of protruding yarn fabrics from the headband. By incorporating the tubular headband, one of those sides can be eliminated with the yarn ending inside of the headband, reducing the amount of yarn incorporated into the wet mop.

Standard wet mops can open during use and expose the floor surfaces and finishes to damage from the mop handle. The tubular design completely encloses the clamping device eliminating damages caused by contact of the mop handle with the flooring surfaces, coatings and finishes.

The tubular headband wet mop may have its enclosed tubular cavity created as one of the following:

A headband covered filler material and a series of yarn strands ending or looping inside the headband, with the headband area sealed with seams or other enclosing methods, creating a tubular cavity;

A headband covered filler material and a series of yarn strands protruding from both sides of the headband, either equally or not, with the headband area sealed with seams or other enclosing methods, creating a tubular cavity;

A series of yarn strands with or without filler material that are formed into a tubular cavity with seams, tape or other methods with the cavity located in the center or other location on the yarn strands.

The tubular headband wet mop would be installed by sliding the clamping arm through the tubular cavity and locking the clamping arm or by inserting the tubular headband into the jaw teeth of a jaw style mop handle and clamping closed.

Thus, one preferred specific embodiment of a tubular headband mounted wet mop have been disclosed that illustrates a best mode now contemplated for putting the tubular headband mounted wet mop into practice. The tubular headband mounted wet mop is described in detail without attempting to show all of the various forms and modifications in which the tubular headband mounted wet mop might be embodied. It should be apparent to those skilled in the art that many more modifications besides those described are possible without departing from the inventive concepts herein. The inventive subject matter, therefore, is not to be restricted except in the spirit of the appended claims.

The invention claimed is:

1. A method of creating a tubular cavity with the elongated yarn strands of a wet mop comprising:

collecting a plurality of elongated yarn strands at a first end at a location within a headband and protrude from only one side of said headband;

sewing or otherwise binding said plurality of elongated yarn strands to said headband;

installing and securing a filler material that approximates a thickness of said elongated yarn strands within said headband in an area that is not occupied by said plurality of elongated yarn strands;

folding said headband and said filler material onto itself to create a closed looped headband, and securing said headband in a looped configuration.

2. The method of creating a tubular cavity with the elongated yarn strands of a wet mop according to claim 1 that further includes a filler material within said headband.

3. The method of creating a tubular cavity with the elongated yarn strands of a wet mop according to claim 1 wherein said securing is selected from a group consisting of using tape, sewn seams, adhesives, fabric, staples and mesh.

4. The method of creating a tubular cavity with the elongated yarn strands of a wet mop according to claim 1 wherein said securing is with the use of a clamping or binding device that creates a closed tubular cavity.

5. The method of creating a tubular cavity with the elongated yarn strands of a wet mop according to claim 1 wherein said headband allows for securing said mop by gripping on an outside of said mop headband or insertion of a clamping arm through said mop headband.

* * * * *